United States Patent [19]

Washburn

[11] 4,107,570

[45] Aug. 15, 1978

[54] CATHODE RAY TUBE INDEXING STRUCTURES

[76] Inventor: Clayton A. Washburn, 24 Andrea La., Thornwood, N.Y. 10594

[21] Appl. No.: 585,922

[22] Filed: Jun. 11, 1975

Related U.S. Application Data

[62] Division of Ser. No. 340,167, Mar. 12, 1973, Pat. No. 3,914,651.

[51] Int. Cl.[2] ..... H01J 29/10; H01J 29/32

[52] U.S. Cl. ..... 313/471; 358/70

[58] Field of Search ..... 313/471, 401, 399; 358/70, 67

[56] References Cited

U.S. PATENT DOCUMENTS

| | | | |
|---|---|---|---|
| 2,303,563 | 12/1942 | Law | 313/176 X |
| 2,540,635 | 2/1951 | Steier | 313/401 |
| 2,705,764 | 4/1955 | Nicoll | 313/471 |
| 2,769,733 | 11/1956 | Pool | 313/471 X |
| 2,778,971 | 1/1957 | Sunstein | 358/70 X |
| 2,829,265 | 4/1958 | Harper | 250/488 |
| 2,879,444 | 3/1959 | Nunan | 313/466 |
| 2,926,283 | 2/1960 | Bruining et al. | 313/471 X |
| 3,360,671 | 12/1967 | Salgo et al. | 313/370 |

FOREIGN PATENT DOCUMENTS

| | | | |
|---|---|---|---|
| 1,090,708 | 10/1960 | Fed. Rep. of Germany | 313/471 |

*Primary Examiner*—Robert Segal
*Attorney, Agent, or Firm*—Nolte and Nolte

[57] ABSTRACT

A cathode ray tube gun structure for minor deflection of an electron beam and employing electrostatic beam deflecting electrodes ultimately controlled by a deflection signal at a low voltage level for minor deflection of the beam. The minor beam deflection electrodes may be positioned in the low beam potential focus region of the gun to provide for minor deflection of the beam. The electrodes may be enclosed in a cylindrical electrode, the latter being used for focusing the beam, or the cylindrical electrode may be omitted in which case focusing and deflection functions are provided by the minor beam deflection electrodes. The minor beam deflection electrodes may be positioned in a high beam potential region, in which case low voltage control is provided by capacitive coupling through the envelope of the tube. The deflection electrodes may also be employed as the conventional second grid structure in a cathode ray tube gun structure.

A cathode ray tube gun structure having a grooved cathode surface in conjunction with grid structures containing rectangular apertures therein for the formation of a beam substantially rectangular in cross section having uniform beam density across the section.

A screen for a cathode ray tube having a mosaic of elements, in which one or combinations of elements located between the glass face plate and a conventional backing layer are employed to enhance or inhibit secondary emission of electrons, as desired, for various regions of the mosaic.

A screen for a cathode ray tube having a curvature defined by a radius R, the center of curvature of which is positioned at the center of magnetic deflection of the major beam deflection structure.

22 Claims, 13 Drawing Figures

Fig. 1.
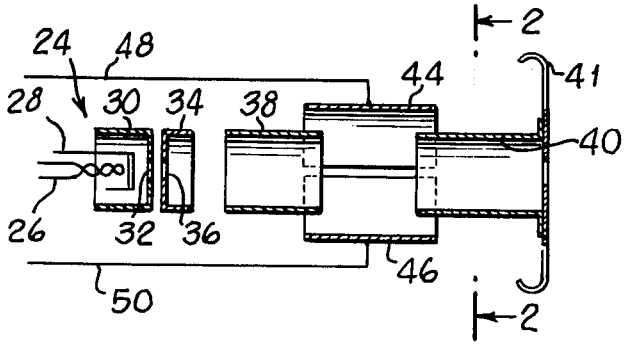
Fig. 2.
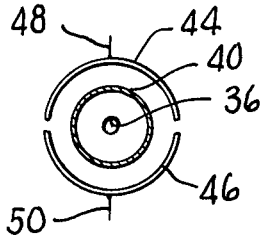
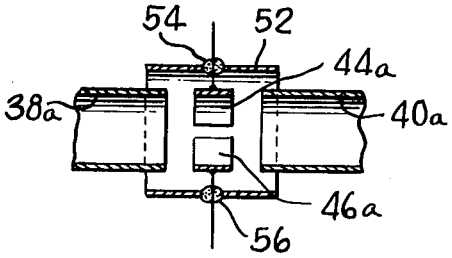
Fig. 3.
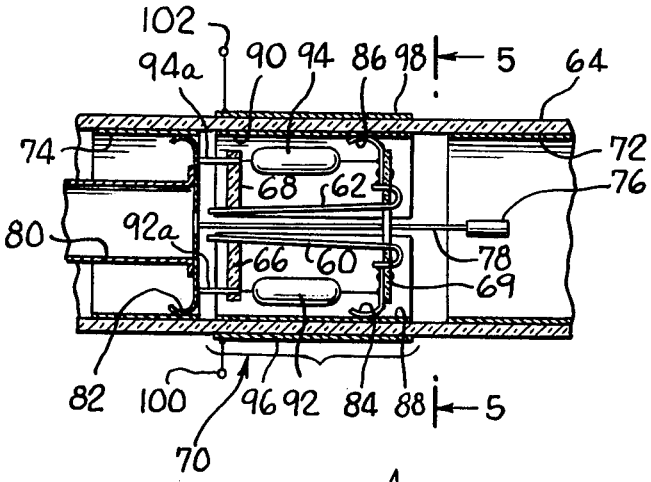
Fig. 4.
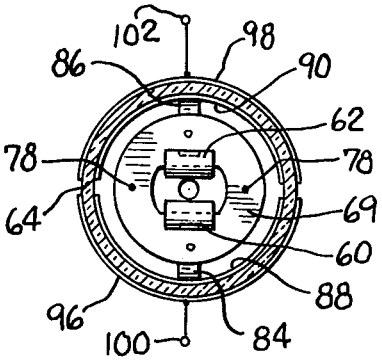
Fig. 5.

Fig. 6.
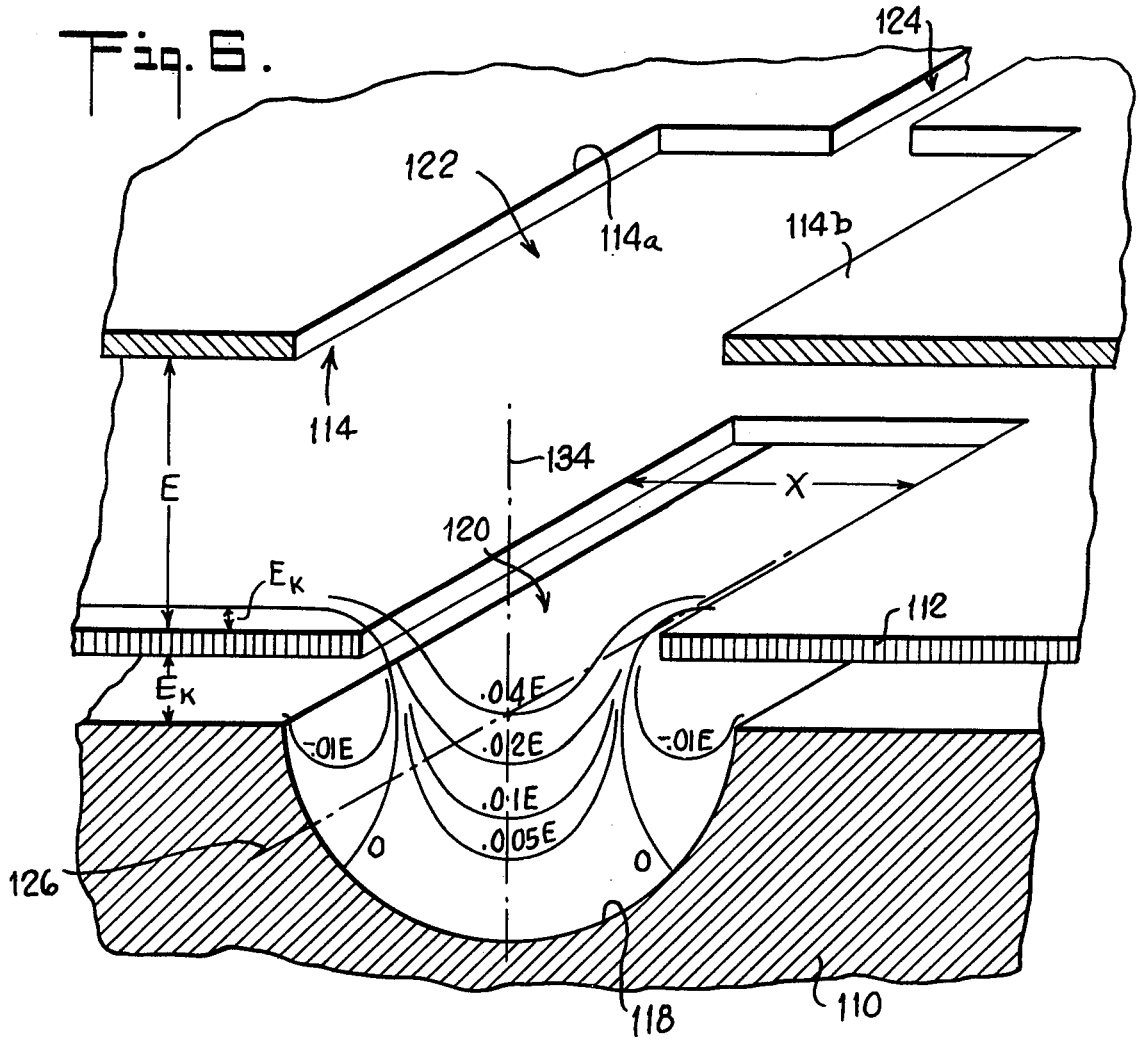
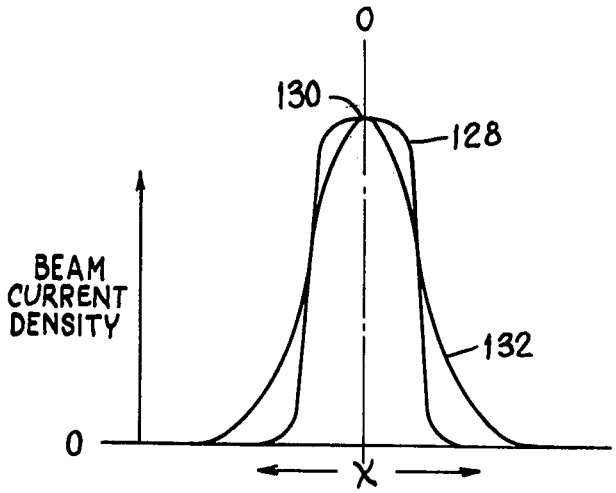
Fig. 7.

Fig. 8.
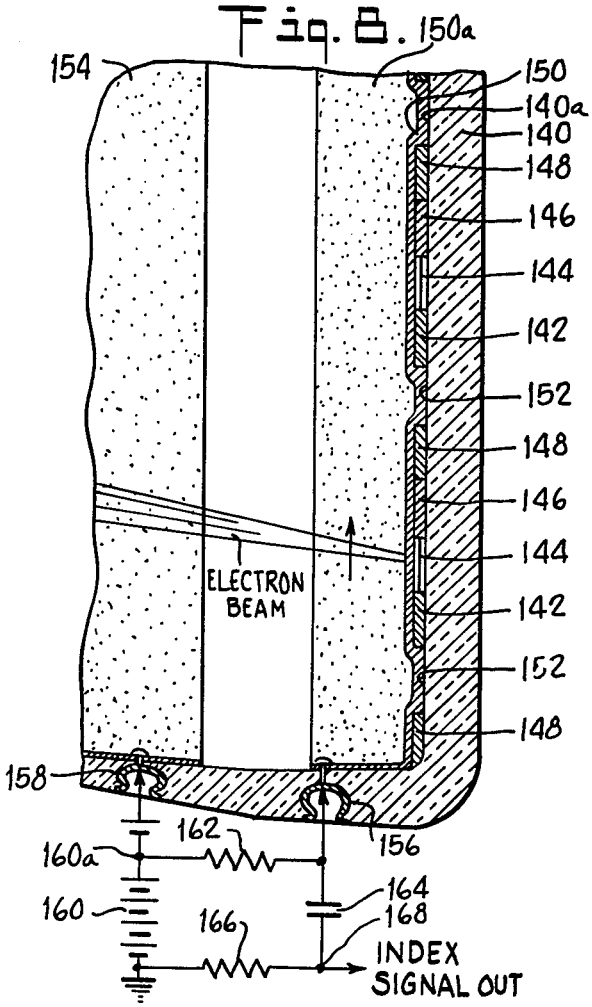
Fig. 10.
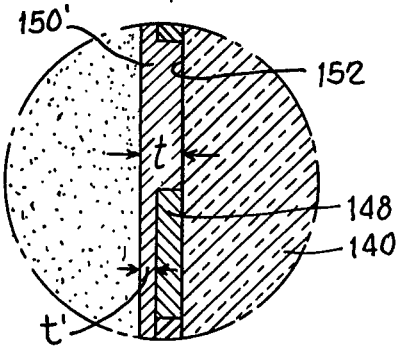
Fig. 11.
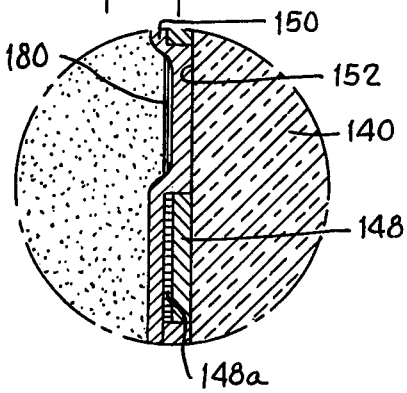
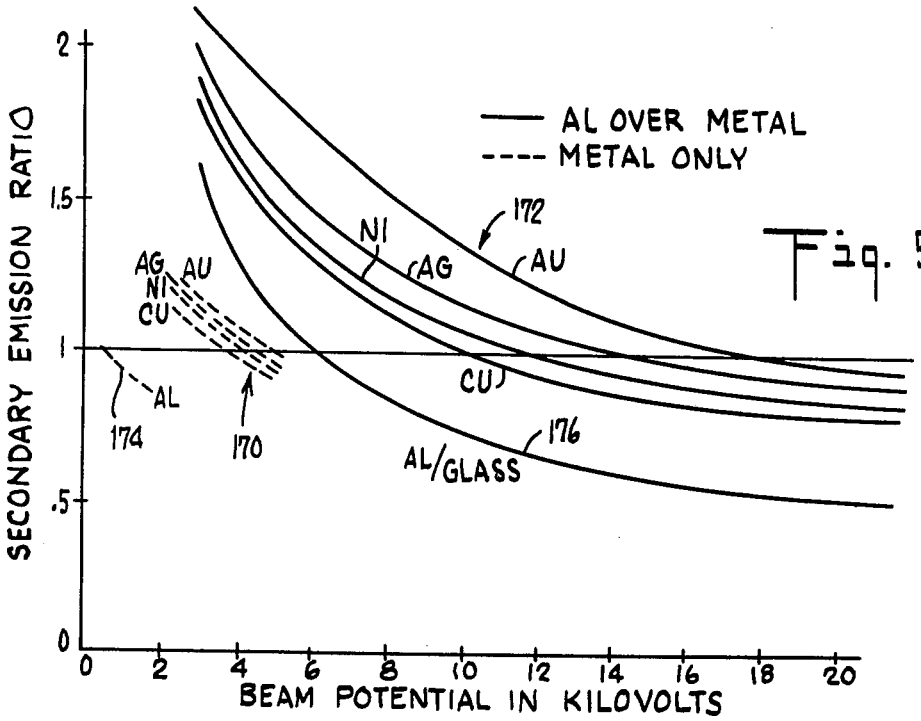
Fig. 9.

CATHODE RAY TUBE INDEXING STRUCTURES

This is a division, of application Ser. No. 340,167 filed March 12, 1973, now U.S. Pat. No. 3,914,651, issued Oct. 21, 1975.

This invention relates to cathode ray tube structures, including cathode ray tube gun structures and cathode ray tube screen structures.

The invention has particular application in systems such as those shown in applicant's copending applications: Ser. No. 389,824 filed Aug. 10, 1964 for Color Television Image Reproduction System and Ser. No. 592,625 filed November 7, 1966 for Error Correction System for Cathode Ray Tube Information Display.

It is oftentimes desired to add a relatively low amplitude, high speed minor deflection to a cathode ray tube scanning beam which is undergoing relatively low speed, high amplitude major deflection. For example, in a color television receiver a cathode ray tube scanning beam may be deflected across the face of the tube in a typical raster scansion. The minor deflection may be employed periodically to deflect the beam over a minor deflection range and in a direction reverse to its movement during a line scan so that the beam impinges upon the proper color element in the particular region of the tube face in which the beam is located. As another example, in graphical displays, the minor deflection of the beam may be employed to produce particular characters, symbols or component portions of the display, while the major deflection is used to position each such character, symbol or component portion at a preselected position on the screen.

In most applications employing relatively large cathode ray tube screens, employing large angles of beam deflection and relatively high electrode potentials for accelerating the beam, it is desirable to employ magnetic deflection of the beam for the major deflection referred to above since higher resolution with screen brightness may be achieved than that possible with electrostatic deflection. However, magnetic deflection of the beam requires more power than that required for electrostatic deflection. With small amounts of beam displacement, electrostatic deflection does not degrade the resolution of the beam, and hence electrostatic deflection is desirable for the minor beam deflections referred to above. Electrostatic deflection at high beam potentials presents a number of problems. In particular, high voltage coupling elements are required to couple deflection plates at a region of high voltage to low magnitude deflection signals at or near ground level. The high potential connections through the tube envelope must be adequately insulated to avoid breakdown because of the high potential differences involved. In the event that the high potential leads are brought out down the neck through the base of the cathode ray tube past other gun structures and elements at low potentials, charge leakage from the high potential leads to the low voltage structures may disturb the electrostatic fields of the fun structure, thereby degrading performance. Flashover in these same areas from the high potential conductors to the low potential structures may disrupt the cathode ray tube display or damage the structure. One way of avoiding these problems is to extend the high potential conductors through the cathode ray tube envelope to adjacent connections on the neck of the tube. This is a difficult and expensive assembly and has limited application, since access to the neck of the tube in this region may be severely restricted because of the magnetic yoke assembly in this region, which prohibits adequate high potential insulation.

These problems are solved in an embodiment of the present invention by providing minor deflection of the beam (as distinguished from major deflection) through the use of electrostatic deflecting elements positioned within a low beam potential region of the gun. In this region, deflecting electrodes at or near ground potential may be used to deflect the beam, and the leads from these electrodes may be conveniently brought out down the neck through the base of the tube past other gun structures and elements at low voltage without the problems mentioned above. The minor beam deflection electrodes may be positioned in the focus region of a conventional "zero focus" cathode ray tube gun structure, inside the zero focus cylindrical electrode, or the deflecting electrodes may replace the cylindrical zero focus electrode in which case the deflecting electrodes provide for minor beam deflection as well as beam focusing. The minor beam deflecting electrodes also may be employed in place of the conventional single electrode second grid structure of a conventional cathode ray tube gun structure.

The invention also employs deflecting electrodes in a high beam potential region of the gun, in which case capacitive coupling provided by conductive surfaces on the inside and outside of the neck of the cathode ray tube couple the deflecting electrodes to a relatively low potential deflection signal source. In this case the connections on the outside of the neck of the tube are at a low potential, thereby avoiding the problems mentioned above with respect to high voltage insulation.

In gun structures of the prior art, so-called "dimpling" of the cathode has been employed (i.e., a cavity in the cathode surface) to provide for better beam formation through the use of a beam emitting surfaces that more closely conforms in shape to equipotential regions adjacent the cathode than is provided by a planar cathode surface. In the present invention, such a cathode cavity is employed in combination with spaced apart electrodes to which a small differential potential is applied in order to deflect the beam so as to overcome problems of alignment of gun structure elements. The grid electrodes in such structure may be formed with apertures over the cavity so as to enhance the formation of the beam.

The present invention also involves an improved screen for a cathode ray tube having a mosaic in which preselected areas thereof are desired to be more secondarily emissive than other areas for the purpose of beam registration control. Such areas, when impinged upon by an electron beam, provide a signal which may be used periodically to register the position of the beam during its major scan movement. Beam registry is particularly important in color television applications in which the beam major scan movement is positionally related to each of successive groups of light emissive elements (red, green and blue light emissive elemental areas on the screen) to provide a color picture. Beam registry is improved by providing a dense material in front of the conventional aluminized backings at positions where high secondary emission is desired.

The present invention also involves a curved screen having a radius R, the center of curvature of which is positioned at the center of major beam magnetic deflection. Such a curve screen permits linear deflection of the electron beam along the screen and provides a uniform secondary emission signal independent of angle of beam deflection.

Accordingly, an object of the present invention is to provide improved cathode ray tube structures. In the accompanying drawings:

FIG. 1 is a sectional view of a cathode ray tube gun structure in accordance with the invention.

FIG. 2 is a sectional view of the gun structure of FIG. 1, taken along the section line 2—2 of FIG. 1.

FIG. 3 is a sectional view of part of an alternative gun structure in accordance with the invention.

FIG. 4 is a sectional view of part of still another gun structure and tube neck in accordance with the invention.

FIG. 5 is a sectional view of the gun and neck structure of FIG. 4, taken along the section line 5—5 of FIG. 4.

FIG. 6 is a perspective view, partly in section, of a cathode and beam deflection electrode structure in accordance with the invention.

FIG. 7 is a diagram showing beam current density as a function of position for the cathode and beam deflecting electrode structure of FIG. 6.

FIG. 8 is a sectional view of part of a cathode ray tube screen in accordance with the invention.

FIG. 9 is a family of curves showing secondary emission ratio versus beam potential for various substances obtained from a structure such as that shown in FIG. 8.

FIG. 10 is a fragmentary view to an enlarged scale of a portion of a screen similar to the screen of FIG. 8 but showing an alternative screen arrangement.

FIG. 11 is a fragmentary view to an enlarged scale of a portion of a screen similar to the screen of FIG. 8 but showing another alternative screen arrangement.

Figure 12:
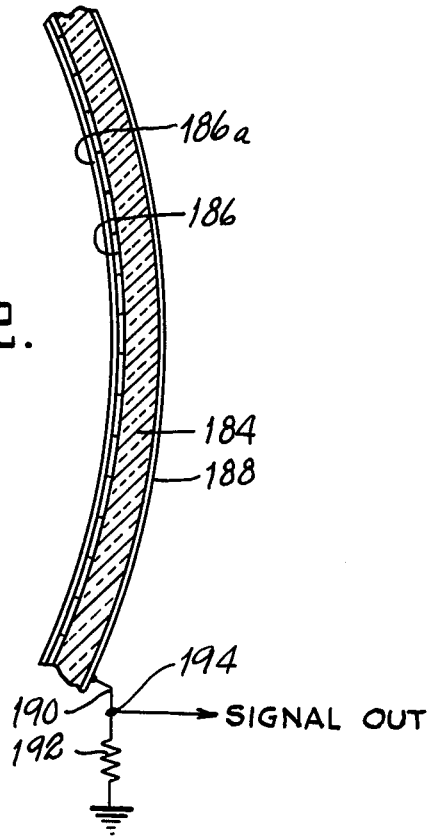
FIG. 12 is a sectional view of a cathode ray tube face plate structure in accordance with the invention.

Turning now to FIG. 1, a cathode ray tube gun structure 24 is shown. The gun structure includes a conventional cathode heating element 26 and a cathode 28; the cathode may be of conventional construction or may be of the type shown in FIG. 6, to be described later. A conventional beam intensity modulation electrode 30, commonly termed a first grid, is employed having an aperture 32 therein. During normal operation, the first grid is biased negatively, typically from a few to roughly 100 volts, to control the magnitude of beam current. A second conventional electrode structure 34, commonly termed a second grid, having an aperture 36 therein is also employed, and is typically operated at a positive potential of from 200 to 1000 volts. The second grid 34 may be of conventional construction, or it may be of the type shown in FIG. 6 to be described later. A conventional anode 38 is also employed in the gun, consisting of a cylinder which is electrically connected inside the neck (not shown) of the cathode ray tube (by connecting means not shown) to a second conventional cylindrical anode structure 40. The anode 40 is in turn connected by a suitable resilient-fingered connecting ring 41 to the usual conventional conductive coating (not shown) inside the neck of the cathode ray tube envelope. The coating is electrically connected to an anode connector (not shown) to which a source of high positive potential is applied to accelerate the electron beam as it emerges from the gun structure 24.

There has been described a so-called zero focus electron gun structure, inasmuch as the region between the anodes 38 and 40, normally employed solely for beam focusing, comprises a region of low beam potential in which beam focusing may be achieved by an electrode at or near ground potential. In this region a focusing element such as a cylindrical sleeve is usually positioned which is essentially at ground or zero potential. In the present invention such a cylindrical sleeve is replaced by two semi-cylindrical sleeves 44 and 46. Electrical conductors 48 and 50 respectively connected to the semi-cylindrical sleeves 44 and 46 may extend past the gun structure to the rear of the cathode ray tube to be passed out through the base of the tube along with other conductors. The semi-cylindrical sleeves 44 and 46 are provided with a relatively low D.C. potential, which provides for focusing of the beam. Superimposed upon the D.C. potential is a differential signal (at a low voltage level) which creates a potential difference between the semi-cylindrical sleeves 44 and 46, as required, for the purpose of deflecting the beam. In other words, when the two electrodes 44 and 46 are at the same potential, they function the same as the single zero focus electrode in a typical prior art cathode ray tube. The magnitude of the potential may be adjusted to provide for optimum focusing of the beam at the cathode ray tube screen. However, when the electrodes are additionally supplied with a differential signal, electrostatic deflection of the beam is provided. Because the beam is at a relatively low potential in the region of the electrodes 44 and 46, a relatively small potential difference is all that is required to provide a substantial value of minor, high speed deflection of the beam. Deflection sensitivity may be maximized by controlling the shape of the electrodes 44 and 46, e.g., by reducing the diameter of the electrodes in the region between the anodes 38 and 40 or by increasing their length, while still maintaining proper focusing of the beam at the screen. Experimental results have shown that during minor scan deflection there are no perceptable distortions of the focussed electron beam in a cathode ray tube gun assembly embodying electrodes such as 44 and 46 for minor deflection as just described.

It will be noted that the two electrodes 44 and 46 concurrently provide for both focusing and minor deflection of the beam in a low beam potential region. The problems associated with deflection of the beam in a region of high beam potential, as noted above, are avoided. The leads 48 and 50, at a relatively low potential level, may be brought out past other gun structures to the base of the tube without creating problems as previously described for leads at a high voltage level.

It will be understood that the electrodes 30, 34, 38, 40, 44 and 46 of the gun structure are each supported in spaced relation to one another and in concentric relation to the axis of the gun structure 24 in conventional manner, as by use of radially extending metal support members (not shown) affixed to each electrode and secured to longitudinally extending glass support rods (not shown) equidistantly spaced around the gun structure, the latter in turn being conventionally supported on a glass button disk or press (not shown) which is fused to and hermetically closes the end of the glass neck of the conventional tube envelope.

FIG. 3 shows an alternative arrangement similar to that of FIG. 1, in which the functions of beam deflection and beam focusing are separated. A pair of deflection plates 44*a* and 46*a*, similar to the plates 44 and 46 of FIG. 1, are employed in a region of low beam potential between anodes 38*a* and 40*a*. A focusing element 52 in the form of a cylindrical sleeve encircling the two electrodes 44*a* and 46*a* is employed. The deflection plates 44*a* and 46*a* may be mounted inside the focusing electrode 52 by means of glass bead insulators 54 and 56. The focus electrode 52 is provided with a unidirectional potential at or near ground potential to provide for proper focusing of the beam. The deflection electrodes 44*a* and 46*a* are provided with differential signal potentials to render the electrodes at slightly different potentials and provide for minor beam deflection of desired magnitude. Again, all conductors associated with focusing and deflection carry low potentials, thereby alleviating insulation problems and problems due to charge leakage associated with conductors of high potential.

FIGS. 4 and 5 show an alternative arrangement for minor beam deflection in which the deflecting electrodes are positioned in a high beam potential region of the cathode ray tube gun structure. Deflecting electrodes 60 and 62 are mounted inside neck 64 of the tube by means of insulating elements 66, 68 and 69, which may be of any suitable ceramic or glass material or mica, for example. The deflection electrodes 60 and 62 are positioned within a region 70 of the neck which lies between cylindrical bands 72 and 74 of conductive material. The band 72 of conductive material is a conductive coating conventionally applied to the inside forward surface of the cathode ray tube and which is connected to the high voltage supply. The conductive coating 72 maintains a uniform high potential field within the cathode ray tube bulb. A pair of contact springs 76 (only one shown) on both sides of the cathode ray tube neck structure contact the conductive coating 72. The contact springs 76 are connected by stiff conductive support wires 78 to a cylindrical anode 80, which may be the final anode element of any conventional cathode ray tube gun structure. A connecting resilient-fingered ring 82 of conductive material is attached to the anode element 80 and contacts the conductive sleeve 74 inside the neck of the cathode ray tube. In this fashion, anode 80 and conductive sleeve 74 are maintained at the same high potential as the conductive sleeve 72.

The beam deflecting electrodes 60 and 62 are connected respectively to contacting springs 84 and 86 (the forward ends of the electrodes include tabs which are retained in corresponding slots in the insulating element 69) which in turn respectively contact conductive semi-cylindrical sleeves 88 and 90 positioned opposite each other on the inside of the neck of the cathode ray tube. The contacting springs 85 and 86 are also respectively connected to the anode 80 of the gun by resistors 92 and 94. These resistors typically may be from one to two megohms in resistance. The resistors must be able to withstand the typical cathode ray tube bakeout temperatures without destruction and without emitting gas. A conventional resistor meeting such requirements is a non-printed carbon film unit on a ceramic base with nickel leads (which are connected to the contacting springs 84 and 86 and to the anode 80) and which is encased in glass. The resistors 92 and 94 maintain the average potential of the deflection electrodes at the potential of the anode 80 and therefore at the potential of the electron beam within this region of the cathode ray tube. The rearward leads from the resistors may terminate in stiff conductive support wires 92*a* and 94*a* which are connected to the anode ring 82 and which support the insulating elements 66 and 68.

Semi-cylindrical conductive sleeves 96 and 98 are positioned on the outside of the neck of the cathode ray tube respectively opposite the semi-cylindrical conductive sleeves 88 and 90 positioned on the inside of the neck. The pair of sleeves 88 and 96 together form a first capacitor, while the sleeves 90 and 98 together form a second capacitor. Input signals at relatively low potential are applied to these capacitors by way of conductors 100 and 102. These signals are coupled by the capacitors 88, 96 and 90, 98 to the deflection electrodes 60 and 62 to cause deflection of the electron beam, as desired.

It should be noted that the glass neck 64 of the cathode ray tube constitutes a dielectric material between capacitor plates 88, 96 and 90, 98. The area of each plate of the capacitor plate pairs is chosen to be about two inches square for a desired cathode ray tube structure. The capacity of the capacitors is then approximately 25 pf each. The deflecting electrodes 60 and 62 also together form a capacitor; in addition each electrode has stray capacity. With typical clearances and dimensions used in practice, the total capacity of each electrode is approximately 5 pf. Hence approximately 83% of each high frequency deflection signal applied to the conductors 100 and 102 is applied to the corresponding deflection electrodes 60 and 62. If each of the resistors 92 and 94 has a resistance of 1.5 megohms, the coupling time constant (RC) is 45 microseconds, and the circuit comprised by these components has a low frequency cut off (down three decibels from the maximum) at approximately 35 kilocycles, a frequency sufficiently low for most applications of this form of the cathode ray tube structure. The structure of FIG. 4 requires no high potential deflection connections through the cathode ray tube neck 64 or high potential leads in the low potential gun region, since the high potential associated with the electrodes 60 and 62 is supplied from the anode 80 through resistors 92 and 94. Hence the outer sleeves 96 and 98 on the neck of the tube are at relatively low potentials, and the problems associated with prior art high potential deflection structures are thereby eliminated.

FIG. 6 shows a cathode ray tube gun structure in accordance with the invention. Cathode 110 corresponds to cathode 28 in FIG. 1, electrode 112 corresponds to the first grid 30 in FIG. 1, and split electrode structure 114 corresponds to the second grid 34 in FIG. 1. In FIG. 6, cavity 118 in the cathode is of thermo-electron-emissive material. The cavity 118 is an elongated groove and is arcuate (typically semi-circular or of parabolic contour) in cross section. The first grid 112 includes a rectangular aperture 120 which has a width $x$ as shown in the figure. The aperture 120 is located above the elongated cathode groove 118. The plane of the first grid 112 includes or is spaced closely to the center of the axis of curvature 126 of the cathode groove 118. The second grid 114, fabricated as two elements 114*a* and 114*b*, defines an aperture 122 located symmetrically above the aperture 120 and hence above the elongated cathode groove 118. The two grid elements 114*a* and 114*b* are electrically separated by a narrow slit 124. The rectangular aperture 120 and 122 of the grids, in combination with the grooved cathode cavity 118, provide an electron beam which is substantially rectangular in transverse cross section. Such a beam is useful in many cathode ray tube applications, particularly in the system disclosed in my T.V. color receiver copending application Ser. No. 389,834 referred to above.

FIG. 6 shows equipotential gradient contours adjacent the cathode surface when a potential difference E exists between grids 112 and 114 and a potential difference $E_K$ exists between the cathode 110 and grid 112. The equipotential gradient contuors in FIG. 6 are in reference to cathode potential (considered to be at zero) and for a cathode to grid potential $E_K$ which is equal to +0.1E; i.e., the cathode 110 is at a positive potential with respect to the grid 112.

It will be noted that the equipotential contours are substantially parabolic or circular for potentials just above zero potential, i.e., the potential of the cathode 110. The cross sectional contour of the cathode groove 118 is made to closely conform to the equipotential gradient contours so that the potential gradient above the cathode structure is substantially uniform over a wide area extending between the two zero gradient curves in the figure. Electron emission occurs in the region where the equipotential gradient is positive, i.e., within the region between the zero gradient curves. The amount of cathode emission is strongly influenced by an increasing field gradient. Therefore, in the structure shown in FIG. 6 the emission is relatively uniform over the cathode region between the zero gradient curves. The corresponding beam density in the crossover region, which occurs near the plane of the grid 112, is also substantially uniform.

Curve 128 in FIG. 7 shows typical beam current density variation across the aperture 120 of the grid 112 as a function of displacement x across the grid aperture. It will be noted that within the aperture 120 beam current density is substantially constant at the peak magnitude designated 130 in FIG. 7. Curve 132 in FIG. 7 shows the variation of beam current density as a function of displacement *x* in the aperture 120 which would result if a planar cathode surface (as distinguished from the grooved surface shown in FIG. 6) were employed. Such a planar cathode has a high cathode loading at the center of its emissive area (maximum emission occurs within a narrow region in the center of the cathode) and the effective emissive area is considerably smaller than the effective emissive area in a grooved cathode surface. A grooved cathode surface thus provides a substantially rectangular beam distribution with higher beam current and with lower cathode loading and a lower grid drive.

In the structure of FIG. 6, the split electrodes 114a and 114b provide two important functions. The first is to correct misalignment of the beam, and the second is to provide minor beam deflection as in the minor beam deflecting arrangements described above in connection with FIGS. 1, 3 and 4. In particular, the size of a typical cathode ray tube gun is quite small so that the smallest spacing, such as the spacing between the electrodes 110 and 112 is of the order of a few thousandths of an inch. Maintaining alignment of the first grid aperture 120 with respect to the second grid aperture 122 and the cathode groove 118 in such gun structure is a problem. The split electrode structure 114 may be employed to compensate for misalignment by use of a differential potential applied between the electrodes 114*a* and 114*b*. Such a potential difference has the effect of tilting the equipotential gradient field adjacent the cathode. As the gradient field is tilted due to the differential potential, it shifts off central plan 134 (which bisects the apertures 120 and 122 and the cathode groove 118). The field in effect rotates about an axis which is in or near the plane of the grid 112. When the plane of the grid 112 is positioned so as to include the axis of curvature 126 of the cathode groove 118, the gradient field axis and the cathode groove axis thus coincide or are closely spaced to each other. Hence, especially with a cathode groove 118 of generally circular contour in cross section, the grid drive characteristics and the beam current density distribution do not substantially change as the gradient field is tilted to compensate for misalignemnt of structure.

The differential potential appearing across the electrodes 114*a* and 114*b* may also provide electrostatic deflection of the cathode ray tube beam, in the same fashion as described above in connection with FIGS. 1, 3 and 4. The deflection sensitivity may be maximized by providing an effectively increased length of differential deflection field of the electrodes 114*a* and 114*b* by increasing the thickness of these electrodes. The deflection sensitivity in a structure such as that shown in FIG. 6 is relatively high, because the electrodes 114*a* and 114*b* act on the electron beam while it is at a relatively low beam potential and before the electrons of the beam attain full velocity. Where the amount of minor beam deflection is relatively small, as in the deflection of the beam in a color television receiver to impinge upon one of the three color elements in a region of the screen, the amount of minor scan displacement in the gun structure is insufficient to cause appreciable distortion of the focussed beam shape at the screen.

FIG. 8 shows a screen construction for a cathode ray tube in accordance with the invention. The screen structure may be employed, if desired, with any one of the electron gun arrangements described above. It is also useful with a conventional gun arrangement. The screen construction shown in FIG. 8 is particularly suited for the proper indexing or registration of an electron beam. In particular, a glass face plate 140 of a typical cathode ray tube envelope is shown as having a phosphor screen such as phosphor tri-color stripe elements 142, 144 and 146, bonded to inside surface 140*a* of the face. Elements 148 are indexing elements intended for secondary emission for beam registration. Such arrangement of phosphor stripe elements 142, 144 and 146 as well as the indexing elements 148 provide a mosaic of elements positioned on the inside surface 140*a* of the face of the tube suitable for use by way of example in a color T.V. receiver, as more fully disclosed in the aforementioned pending application Ser. No. 389,824. An electron permeable conductive backing material 150 such as one of aluminum, for example, is deposited over the phosphor elements 142, 144, and 146 and the indexing elements 148. The backing material also fills spaces 152 (which spaces are intended as non-secondarily emissive regions) between the phosphor elements 142 and indexing elements 148.

The backing material 150 may also extend along the sides of the cathode ray tube immediately adjacent the face of the tube as designated 150*a*. Spaced from the conductive band 150*a* is a conventional thin layer of conductive material typically graphite, designated 154, which is connected to the final anode of the cathode ray gun as previously described. Conventional high voltage contacts 156 and 158 are sealed through the wall of the tube envelope and respectively make electrical connection with the conductive layers 150*a* and 154. The contact 158 is typically connected to a positive high voltage source, herein shown as a battery 160 for ease in illustration, to provide an accelerating potential for the electron beam. The contact 156 is electrically connected through a resistor 162 (typically 1 megohm in resistance) to a terminal 160*a* which is at a potential less positive (typically by 500 volts) than the potential applied to the contact 158. The contact 156 is also connected to ground through a capacitor 164 and a resistor 166. Output indexing signals from the structure of FIG. 8 are taken from junction 168 of capacitor 164 and resistor 166.

In operation, the electron beam may strike the cathode ray tube screen so as to excite one of the phosphor elements 142, 144 and 146, causing the element to develop light output, the beam may strike one of the indexing elements 148 to cause a secondary emission of electrons, or the beam may strike areas 152 where little or no secondary emission occurs. The electrons in the beam striking the screen are conducted by conductive coating 150*a* to the contact 156 and through the resistor 162 to high potential top 160*a*. Secondary electrons emitted from the screen are collected by the more positive conductive coating layer 154 from which they are conducted to the high voltage contact 158 and thence to the high potential source 160.

As the electron beam scans across the screen of the cathode ray tube, the currents flowing to the conductive coatings 150*a* and 154 vary depending upon the impingement of the beam on high secondary emission areas 148 or low secondary emission areas 152. The differential current provides an indexing output signal so that the beam may be properly registered, i.e., properly positioned periodically with relation to successive phosphor element positions in a manner more fully disclosed in the aforementioned pending applications. The indexing signals produced by the flow of current in the coatings 150*a* and 154 may be developed from current flowing in either coating. In the circuit shown in FIG. 8 the indexing signal is developed from the current flowing in the coating 150*a*.

The arrangement of the indexing elements 148 in front of the backing material 150 results in enhanced secondary electron emission at the elements 148 and thus provides a large amplitude indexing signal at the output terminal 168 of the external electrical circuit. In particular, the indexing elements 148 consist of a thin film of metal, metal alloy, metal compound or combination, as described in more detail below, in which a principal component is a material having a relatively high atomic number. Gold, platinum, and tungsten are examples of metals suitable for such indexing elements. The backing material 150 cooperates with the indexing elements 148 to provide for more secondary emission when the beam impinges upon the screen in the region of the elements than would be generated if no backing were employed. Further, the backing provides less secondary emission from the free areas 152 which are intended to be non-secondarily emissive.

An explanation of the theory behind the invention will be helpful. When an electron travels through a material, even though no collisions with atoms of the material occur, the electron looses energy to the material; hence its velocity is reduced as it travels through the material. The loss of energy increases with increasing atomic weight of the material through which the electron passes. Therefore, the depth of penetration of an electron in a material increases with the potential of the electron and decreases with the atomic weight of the material.

In travelling through a material, a certain percentage of electrons travels close enough to atomic nuclei to be trapped by the nuclei. Each such electron is deflected in an orbit around a nucleus and is returned in the general direction from which it came without loss of velocity. This phenomena is known as back-scattering. The electrons so deflected in orbit and returned are referred to as primary electrons. The probability that primary electron orbits will occur increases for increasing weights of nucleus and decreases for increasing electron potentials. For low atomic weight materials and high electron beam potentials, the electrons from the beam penetrate to a greater depth and therefore lose considerable energy before there is a relatively high probability of return by the lighter nuclei. The probability that such electrons will re-emerge from the material is thus further reduced. Hence for a given beam potential, the primary electron return is low for materials of light atomic weight and increases with atomic weight.

The bombardment of a material by electrons also results in the emission of secondary electrons due to the bombardment process. It has been shown that maximum total emission occurs at low bombarding electron beam potentials in the range of approximately 100–1000 volts. See Breuning, *Physics and Applications of Secondary Electron Emission,* McGraw Hill. The emission in this range is substantially due to secondary emission and in general increases with the number of outer shell or free electrons in the material bombarded. As the bombarding beam potential is increased above the value which produces maximum secondary emission, there is a gradual reduction of the secondary emission ratio. Consequently, at the high potentials required for many cathode ray tube applications (particularly 10 kilovolts and higher), the secondary emission ratio decreases below unity with increased voltage until the emission of electrons is essentially only due to that resulting from the return of primary electrons as described above.

In the present invention structures are provided, at the desired secondary emissive positions 148 in the screen of the cathode ray tube, which effectively reverse the direction of entering electrons (by means of orbiting around heavy nuclei) so that not only are such electrons returned but their direction is more favorable to propelling other electrons out of rather than further into the material bombarded. The structures also effectively absorb the energy (i.e. potential) of the bombarding electrons sufficiently so that high secondary emission can develop. Finally, materials high in outershell electrons are provided and positioned as will subsequently be described in a manner to produce high secondary emission. Further, the structures are also combined to produce low secondary emission and to provide for the trapping of electrons in areas such as those areas designated 152 in FIG. 8 where a minimum of emission is desired.

Turning again to FIG. 8, when an electron passes through the backing 150 on its way to an indexing element 148, its potential is reduced. On entering the indexing element 148 (which is of relatively heavy atomic weight) a substantial percentage of the electrons are turned around by orbiting around nuclei as just described. Secondary emission in the indexing element 146 produced by entering electrons provides electrons that are propelled into the element, and a percentage of these electrons will also be returned by orbiting around nuclei. The potential of the returned electrons is further reduced by their travel though the indexing element 148 and back through the backing 150, and hence such electrons are able to stimulate more secondary emission during their return travel because of their reduced potential. Thus, the use of a heavy material 148 in front of a light backing material 150 creates an advantageous reversal of direction and lowering of electron potential thereby to increase secondary emission in the region of the indexing elements 148 to provide a stronger output signal at the terminal 168.

FIG. 9 is a family of curves which shows the increasing of secondary emission in structures such as shown in FIG. 8. The curves designated 170 show secondary emission ratio as a function of beam potential for various unbacked materials such as copper, nickel, silver and gold. Curves designated 172 show the secondary emission ratio for the combined material, i.e., copper, nickel, silver and gold when backed with a film of aluminum. It will be noted that to obtain a secondary emission ratio of unity, a much lower electron beam potential must be used for the unbacked materials as compared with the backed materials. For example, unbacked gold requires an electron beam potential of approximately 5000 volts, whereas backed gold will have a secondary emission ratio of unity with a beam potential as high as 17 kilovolts. If an electron beam potential of 5000 volts is employed, unbacked gold will have a secondary emission ratio of unity, whereas backed gold will have a secondary emission ratio of roughly 1.9. It is apparent, then, that the secondary emission ratio is greatly improved when a heavy material is backed with a lighter material, as noted above.

It was pointed out above that the area 152 are desired to be non-electron emissive. Hence a material light in atomic weight which will return very few electrons is desired. Aluminum is suitable as such a light weight material. Conveniently, as in the structure shown in FIG. 8, the backing material 150, which is typically of aluminum, also fills the spaces 152 between the indexing elements 148 and the phosphor elements 142 to serve as a non-emissive indexing element. Measurements have shown, however, that the secondary emission ratio for a thin film of aluminum on glass is higher than the secondary emission ratio for aluminum alone. This is shown in FIG. 9 by the curves 174 and 176. As the high potential electron beam penetrates the aluminum film, some electrons are slowed and reversed at the glass face and stimulate secondary emission on their return in much the same fashion as secondary emission is stimulated in the region of the indexing elements 148. Accordingly, the emission from the aluminum in the areas 152 may be reduced by increasing the thickness of the aluminum at such areas.

FIG. 10 shows an alternative structure in which the thickness ($t$) of the backing material in the region 150' of the non-emissive area 152 is greater than the thickness ($t'$) in the region immediately behind the indexing element 148. In distinction, in the structure shown in FIG. 8, the thickness of the backing material 150 at all points in uniform. The increased thickness in the region 152 will reduce secondary emission in the region, as desired.

FIG. 11 shows another arrangement for reducing secondary emission in the non-emissive areas 152. In FIG. 11 the non-emissive area is covered by the backing material 150, whose thickness is generally uniform throughout the entire screen area as in FIG. 8. A thin layer 180 of a material having a high atomic weight is positioned behind the backing material 150 opposite the area 152. The layer 180 is thin enough so that electrons from the scanning beam penetrate it before there is appreciable probability for return of primary electrons by orbiting around nuclei. Upon penetrating the thin layer 180, the electrons lose considerable energy, and if they or secondary electrons emitted from the light atomic weight material 150 or the glass face 140 are returned, such electrons will not have sufficient energy to escape back through the film of relatively heavy atomic weight material. This structure therefore serves as an electron trap to reduce secondary emission.

FIG. 11 also involves a modification of the secondarily emissive element 148. In particular, there is interposed between the aluminum backing material 150 and an indexing element 148 a layer of material **148*a* which consists of a metal compound composed of relatively light atomic weight elements having high ratios of outer shell electrons. Suitable compounds are, for example, beryllium oxide and magnesium oxide. The outer shells of the atoms of these compounds provide additional electrons which may contribute to secondary emission as explained above. It will be seen that the material 148*a* is located at a position where the return electrons from the element 148, having lost appreciable energy, are able to provide for effective increase in secondary emission during the return travel through the material 148*a* as well as through the backing 150**.

It should be noted that alternative materials may be employed for the indexing elements 148. One such alternative arrangement, that of FIG. 11, has just been described. In FIG. 10, the heavy atomic weight metal forming the material 148 may be replaced by a material of any of a wide variety of metal alloys or compounds, one element of which is a heavy atomic weight metal, and the other of which is a lighter element or elements included to increase the path length of penetrating electrons and hence reduce the potential of orbiting primary electrons, and also to provide a large number of outer shell electrons. As noted above, such an arrangement further improves the probability of electron collision and hence of increasing secondary emission. As one example, it has been found that when an alloy of a heavy atomic weight material and aluminum is formed, the secondary emission at the boundary is increased. An increase in the secondary emission ratio in the order of two has been measured when indexing element 148 is changed from gold to a gold-aluminum alloy. Examples of compounds which may be employed for indexing elements 148 and suitable with electron beam potentials in the range of 20 kilovolts are gold chloride and red lead ($Pb_3O_4$).

It should be noted that alloying between the backing layer material and the indexing element material may be provided as part of the bakeout cycle of the cathode ray tube during fabrication or as an auxiliary operation, if materials having a compatible alloying temperature range are used for element 148 and the backing material 150. It has been found that such alloying enhances secondary emission for the materials shown in FIG. 9. Such an alloy structure gives similar results as would be provided by use of the same alloy for element 148 of FIGS. 8, 10 and 11.

In the screen arrangements of FIGS. 8, 10 and 11, the backing layer 150 (150' in FIG. 10) is of a thickness the same as the conventional backing of aluminum typically employed in cathode ray tubes. Ordinarily, the backing material normally will be a fraction to a few microns thick. It must be thick enough over phosphor areas to be optically opaque but not so thick as to unduly absorb the beam energy, hence is typically thicker for applications requiring high beam potential and typically absorbs from a fraction to over 1000 volts of potential. Since it is desired to absorb the beam energy in secondary emission areas, additional thickness in the order of microns may be provided there by the layer 148*a*. The indexing elements 148 of heavy material also will typically be the order of a fraction to a few microns thick; the required thickness depends upon beam potential and should be sufficient to prevent electrons from penetrating completely through the layer 148. The layer 180 of FIG. 11, described above, must be thin enough to absorb only a fraction of the beam energy (approximately 1/5 to ⅓) before the electrons penetrate it, hence must be of controlled thickness and considerably thinner than indexing element 148.

In summary, in the screen arrangements shown in FIGS. 8, 10 and 11, the enhancing of secondary emission in the regions of the indexing elements 148 involves three functions. First, the electron beam is slowed to lower the potential of the electrons in the beam. Second, the direction of travel of the electrons is reversed so that the electrons are actually moving out of the screen in a general direction back toward the electron gun assembly. Third, a large number of free electrons near the surface of the screen in or just under the backing film 150 is provided. The combination of materials, such as the backing film 150 and each indexing element 148 shown in FIG. 8, provides all these functions, and the combination then enhances secondary emission from the regions of the indexing elements. In particular, the secondary emission is increased over that which would take place if the indexing elements were directly impinged by the electron beam without requiring the beam to traverse the backing film.

A further advantage in the arrangements of FIGS. 8, 10 and 11 is that the indexing elements 148 are deposited directly on the inside surface of the face plate 140 of the cathode ray tube. In prior secondary emission arrangements, the indexing elements have been placed in a desired relationship to, but behind, the phosphor elements on the cathode ray tube screen. Interposed between the phosphor elements and the indexing elements has been the aluminum screen backing which is used to reflect the light output from the phosphor elements forwardly through the glass face plate of the tube. A serious problem has arisen in the past from unequal expansion and/or contraction of this aluminum backing during the high temperature processing of the cathode ray tube during tube fabrication. The unequal expansion and/or contraction produces a movement which destroys the precise registration between the indexing and phosphor elements necessary in order to provide accurate control of the cathode ray tube beam. In the present invention, by placing the indexing and phosphor elements on the inside of the backing film 150, registration problems are avoided since no longer are the phosphor and indexing elements on opposite sides of the backing layer.

Other disadvantages with prior art screen arrangements have involved comparable inherent secondary emission of typical phosphor elements when compared with indexing secondary emission materials. In the past, then, there has been relatively little difference in signal developed between impingement of the beam on what is intended to be an emissive area and what should be a non-emissive area. In the present invention, areas having enhanced secondary emission and areas having suppressed secondary emission are provided. A large differential indexing signal may thereby be developed from these areas independent of secondary emission from the regions of the phosphor elements. A further disadvantage of prior indexing screen arrangements has been caused by the large grain structure of phosphor elements. Secondary emission variations due to electrons penetrating these grains at glancing angles is substantial and has resulted in variable and noisy indexing signals. The secondary emission structures described may employ materials with none or very fine grain structure so that uniform indexing signal output is obtained.

Another difficulty in previous screen arrangements has been a substantial reduction of secondary emission output as the velocity of the impinging electron beam is raised to the levels required for typical cathode ray tube operation. As shown in FIG. 9, the combination of backing layer and indexing element enhances secondary emission and provides suitable secondary emission ratios with the relatively high beam potentials involved in typical cathode ray tube operation.

FIG. 12 shows in section a portion of a cathode ray tube screen. The screen comprises a glass face plate 184 which may be the face plate of a cathode ray tube envelope. Alternatively, and as an example, the face plate 184 may be a glass substrate mounted inside a typical cathode ray tube adjacent to the cathode ray tube face plate and perpendicular to the electron gun axis. There is deposited on the inside surface of the face plate 184 a screen structure 186 which may comprise any of the screen structures previously described. The elements of the screen structure 186 are applied over the screen area in any desired pattern to provide beam indexing and cathode ray tube output signals which are generated in accordance with a predetermined method of beam scanning and with the pattern of the screen structure elements. An inside or backing layer 186*a* is provided, typically of aluminum, and corresponds to the backing layer 150 in FIGS. 8 and 11 and the backing layer 150' shown in FIG. 10. On the outside of the face 184 a conductive coating 188 is applied. The glass face 184 serves as a dielectric between inside conductive coating 186*a* and the outside conductive coating 188 to provide a capacitor. A conductor 190 connects the outer conductive coating 188 to a grounded resistor 192. The capacitor provided by the coatings 186*a* and 188 serves as the equivalent of the capacitor 164 in FIG. 8. An output signal from the circuit of FIG. 12 is developed at terminal 194.

Figure 13:
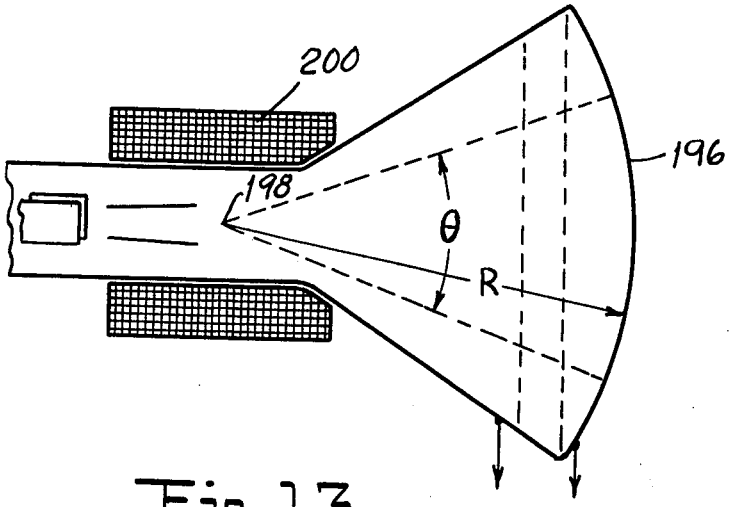
FIG. 13 is a simplified view of part of a cathode ray tube employing a screen having a radius of curvature R, the center of curvature of which is positioned in the center line of the major beam deflection structure, in accordance with the invention.

In typical cathode ray tube structures employed in the prior art, the displacement of the beam across the tube screen is non-linear with respect to the input deflection signal because of the relatively flat face plate of the cathode ray tube. In signal generating tubes useful in the present invention, requiring accurate registration of the scanning beam, it is desirable that beam movement vary linearly with input deflection signal. FIG. 13 shows a cathode ray tube face plate construction which satisfies such linearity. In particular, face plate 196 is formed with a radius R, and the tube dimensions are proportioned so that the distance between the interior surface of the face plate and center 198 of major beam deflection of the yoke 200 is made equal to or slightly less than R. It will be noted from FIG. 13 that the center of curvature of the screen thus is substantially on the center of magnetic deflection 198 of the deflection yoke. In a typical high quality deflection yoke, beam deflection angle is proportional to or is slightly less than the deflection field current. Since the distance along the face plate 196 that an electron beam travels is equal to R times the angular deflection, the displacement along the surface of the screen will be proportional to the deflection current, as desired. The face plate 196 may have deposited thereon any conventional screen or any of the screen arrangements of FIGS. 8 and 10–12, e.g.

It should be noted that the curved face plate 196 (formed with the radius R and whose center of curvature is positioned on the center 198 of magnetic deflection of the deflection yoke 200) is advantageous since it ensures that the electron beam impinging on the screen strikes the screen perpendicularly, with substantially little glancing impingement of the electrons. With all electrons striking the screen substantially perpendicularly, regardless of the position of the beam on the screen, secondary emission is rendered substantially uniform. In prior art arrangements having a relatively flat face plate not involving this type of screen curvature, the beam of electrons strikes the screen at various angles, producing varying degrees of secondary emission depending upon the angle of impingement of the electrons. Varying secondary emission may be compensated for by clipping the signals developd from the secondary emission of electrons. Signal clipping necessarily reduces the magnitude of the developed signals, and hence with the present face plate curvature less clipping is required, resulting in increased signal strength.

A number of embodiments of the invention have been disclosed. It is apparent that modifications may be made of such embodiments. For example, in FIGS. 8, 10 and 11 the invention has been described in terms of a typical cathode ray tube of phosphor light emitting elements. The features of the invention are useful in cathode ray tube systems which do not depend upon light output. For example, signal generating system such as a monoscope test pattern generator, which employ secondary emission elements independently or in conjunction with other screen structures besides phosphors may be employed in the practice of the invention. Accordingly, the invention should be taken to be described by the following claims.

What is claimed is:

1. A screen for a cathode ray tube, comprising a supporting surface, a mosaic of elements positioned on said surface, selected ones of said elements being free of phosphoros and comprising indexing elements atoms of which have high atomic weight, said indexing elements being positioned in predetermined areas of said surface, and a backing film against said mosaic and of a material having an atomic weight less than the atomic weight of said indexing elements.

2. A screen for a cathode ray tube as defined in claim 1, wherein said backing film is of aluminum.

3. A screen for a cathode ray tube as defined in claim 1, wherein said indexing elements are made from a material which is in the atomic weight range including copper, nickel, silver, platinum and gold.

4. A screen for a cathode ray tube as defined in claim 1, wherein selected ones of the elements of said mosaic are spaced from each other to define element-free regions in the mosaic adjacent to said indexing elements, the backing film extending over all of said mosaic elements and said element-free regions, the thickness of said backing film being substantially thicker in the portions thereof backing said element-free regions than the portions thereof backing said indexing elements.

5. A screen for a cathode ray tube as defined in claim 1, wherein said indexing elements are of a relatively high atomic weight metal.

6. A screen for a cathode ray tube as defined in claim 1, wherein said indexing elements are comprised of a material constituting an alloy, one element of which alloy is a material of relatively high atomic weight and another element of which is a material of relatively low atomic weight.

7. A screen for a cathode ray tube as defined in claim 1, wherein said indexing elements are comprised of a material constituting a compound, one element of which compound is a metal of relatively high atomic weight and one or more other elements of which have relatively low atomic weight.

8. A screen for a cathode ray tube as defined in claim 1, including a further film of material positioned between said backing film and each of said indexing elements, said further film constituting a metal compound of elements relatively light in atomic weight having a relatively high ratio of outer shell electrons.

9. A screen for a cathode ray tube as defined in claim 1, wherein selected ones of the elements of said mosaic are spaced from each other to define element-free regions in the mosaic adjacent to said indexing elements, said backing film being included in said element-free regions, and a further film opposite said element-free regions and on the rear surface of said backing film, said further film having an atomic weight greater than the atomic weight of said backing film.

10. A screen for a cathode ray tube as defined in claim 1, wherein the surface of said backing film against said mosaic is alloyed with the surface of said indexing elements thereagainst.

11. A screen for a cathode ray tube as defined in claim 1, wherein said supporting surface comprises a face plate on the inside surface of which said mosaic of elements is positioned, and a conductive film on the outer surface of said face plate forming a capacitor with said backing film.

12. In a cathode ray tube screen of the type having a supporting surface and electron signal generating elements for producing secondary electrons in response to the scanning of an electron beam thereacross; the improvement where said electron signal generating elements are positioned in predetermined areas on said supporting surface and are comprised of atoms having a high atomic weight, said electron signal generating elements having a thickness to substantially prevent electrons of said beam from penetrating said electron signal generating elements, and a backing film covering said elements, said film being of a material having an atomic weight less than the atomic weight of said electron signal generating elements, said film having a thickness dependent upon the potential of said beam to substantially reduce, but by less than one-half, the energy of electrons of said beam as the electrons of said beam pass therethrough to said elements, said film having a thickness to obtain maximum secondary emission from said electron signal generating elements at said beam potential.

13. The cathode ray tube screen of claim 12 wherein said film contacts said electron signal generating elements and also extends into contact with said supporting surface in other areas than said predetermined areas, said film having a greater thickness in said other areas than in said predetermined areas.

14. The cathode ray tube screen of claim 12 wherein said film contacts said electron signal generating elements and also extends into contact with said supported surface in other areas than said predetermined areas, further comprising a layer of a material having an atomic weight greater than the atomic weight of said backing film in the regions thereof only overlying said other areas, said layer having a thickness to absorb a fraction of the energy of said beam.

15. The cathode ray tube screen of claim 14, wherein said layer has a thickness to absorb from one-fifth to one-third of the energy of said beam.

16. The cathode ray tube screen of claim 12 wherein said supporting surface is of a material having low secondary emission.

17. The cathode ray tube screen of claim 12 wherein said elements and said film have thicknesses up to the order of a few microns.

18. The cathode ray tube screen of claim 12 wherein said supporting surface comprises a face plate of a cathode ray tube, said elements being in contact with said face plate, and further comprising elements of phosphor materials on said face plate in areas other than said predetermined areas, said film extending also to cover said phosphor elements and being only thick enough to be optically reflective over said phosphor elements.

19. The cathode ray tube screen of claim 18 wherein said face plate has further areas on which electron signal generating elements and elements of phosphor materials are not provided, said film extending into contact with said further areas and having a thickness overlying said further areas greater than the thickness overlying said electron signal generating elements and elements of phosphor materials.

20. A screen for a cathode ray tube comprising a face plate, a mosaic of elements comprising materials positioned in predetermined areas on the surface of said face plate, selected ones of said elements comprising electron emissive indexing elements, the material of said indexing elements containing a substantial proportion of atoms of high atomic weight, the materials of other areas of said mosaic comprising phosphor, and a backing film against said mosaic, said backing film comprising a material including a substantial proportion of atoms of low atomic weight.

21. The cathode ray tube screen of claim 12 wherein said supporting surface comprises a face plate of a cathode ray tube, said elements being in contact with said face plate, and further comprising elements of phosphor materials on said face plate in areas other than said predetermined areas, said film extending also to cover said phosphor elements and having a thickness as to be optically opaque while not substantially absorbing the beam energy of said cathode ray tube.

22. A target structure for a cathode ray tube having an electron beam, the target structure comprising a mosaic of elemental areas, first and second selected ones of which comprise structures with controlled high and low secondary emission characteristics respectively when impinged by said electron beam, said first selected areas having a structure comprising an electron reflective layer containing a substantial proportion of at least one high atomic weight element, and a backing layer on said reflective layer comprised of a controlled thickness of an electron permeable conductive material, comprised of a substantial proportion of a material having an atomic weight substantially lower than said high atomic weight element, said backing layer having a thickness to reduce the average energy of said beam to the range of from 100 to 1,000 volts.

* * * * *